US006534776B2

(12) United States Patent
Dougherty et al.

(10) Patent No.: US 6,534,776 B2
(45) Date of Patent: Mar. 18, 2003

(54) VESSEL FOR URANIUM HEXAFLUORIDE TRANSPORT

(75) Inventors: Thomas F. Dougherty, Chagrin Falls, OH (US); Trevor M. Rummel, Leetonia, OH (US)

(73) Assignee: Columbiana Boiler Company, Columbiana, OH (US)

( * ) Notice: Subject to any disclaimer, the term of this patent is extended or adjusted under 35 U.S.C. 154(b) by 0 days.

(21) Appl. No.: 09/840,314

(22) Filed: Apr. 23, 2001

(65) Prior Publication Data

US 2002/0153498 A1 Oct. 24, 2002

(51) Int. Cl.[7] ..... G21F 5/12
(52) U.S. Cl. ..... 250/506.1; 250/507.1
(58) Field of Search ..... 250/506.1, 507.1

(56) References Cited

U.S. PATENT DOCUMENTS 4,197,467 A * 4/1980 Williams ..... 250/506.1
5,777,343 A 7/1998 Rasel et al. ..... 250/506.1

OTHER PUBLICATIONS

ANSI Pub. 14.1–1990, pp. 19–24, 44–49.
Nuclear Fuel Transport System Co, Ltd. single page drawing titled "UF 6 Cylinder for Model RU–1 Packaging Cylinder Assembly."
The RU–1 cylinder illustrated in this drawing was designed and manufactured in the United States by the assignee of the present invention and shipped to Japan for use there for storing reprocessed uranium. This was done more than one year before the filing date of the present applicaion.

ANSI Pub. 14.1–1995, pp. 9–13.

* cited by examiner

*Primary Examiner*—Jack Berman
(74) *Attorney, Agent, or Firm*—Renner, Otto, Boisselle & Sklar, LLP

(57) ABSTRACT

A vessel for the shipment of uranium hexafluoride includes a cylindrical wall closed by pair of approximately semi-ellipsoidal heads welded to form a sealed container. A service valve is located in one end. The valve is covered by a removable, watertight valve protection cover assembly. The vessel also includes a test port by means of which the integrity of the valve protection cover assembly may be tested after the cylinder has been filled with uranium hexafluoride and the valve protection assembly has been installed. The valve protection assembly is shaped so that it fits within the envelope of the standard 30B cylinders. The distal end of the valve protection assembly is recessed from a plane defined by the open end of the surrounding chime by at least one half inch, and preferably by ¾ inch or more. Accordingly, the fits within an overpack already approved by the NRC and used by shippers of uranium hexafluoride.

39 Claims, 4 Drawing Sheets

VESSEL FOR URANIUM HEXAFLUORIDE TRANSPORT

BACKGROUND OF THE INVENTION

The present invention relates to a vessel for the transportation and storage of uranium hexafluoride, and particularly to improvements in a vessel known in the trade as a 30B cylinder.

Enriched uranium hexafluoride has been shipped in conventional 30B cylinders for many years. Uranium hexafluoride is considered enriched if it includes more than 1% Uranium 235 ($U_{235}$), and shipments of enriched uranium hexafluoride (up to and including 5% by weight) must be made in conventional, approved 30B cylinders. Such cylinders filled with uranium hexafluoride must be shipped in an approved overpack for impact and thermal protection. Such shipments are considered safe if the cylinders are properly packaged and transported. So long as water or other possible moderators of neutrons are kept separate from the uranium hexafluoride itself, a critical event (an uncontrolled nuclear chain reaction) cannot occur.

As with all aspects of the nuclear industry within the geographic limits of its authority, the Nuclear Regulatory Commission (NRC) regulates the transport of uranium hexafluoride. Because its authority extends to United States ports and because its regulations are among the most conservative in the world, the NRC's regulations establish minimum standards for most international shipping of uranium hexafluoride. American National Standards Institute, Inc. published ANSI N14.1, Packaging of Uranium Hexafluoride for Transport, in 1971. This standard was adopted by the NRC's predecessor and established the approved design of the conventional 30B cylinder.

ANSI N14.1 specifies the types of materials for which its approved cylinders are suitable. Specifically, ANSI N14.1, Section 5.5, Packaging Requirements, Standard $UF_6$ Cylinders, Table 1, footnote a, provides that a conventional 30B cylinder may be used to ship uranium hexafluoride that contains less than 0.5% impurities. For purposes of this application, a mixture consisting of at least 99.5% by weight uranium hexafluoride and the balance other materials is termed "substantially pure" uranium hexafluoride.

The conventional 30B cylinder, currently defined by ANSI N14.1-1995, is a steel vessel about 81½ inches long and 30 inches in diameter. It is made from half-inch carbon steel formed into a cylindrical body 54 inches long capped by two roughly semi-ellipsoidal heads. A pair of chimes protect the ends of the vessel. The conventional 30B cylinder has a tare weight of about 1425 lbs. and a volume of at least 26 cubic feet. When filled to its maximum permitted capacity of 5020 lbs. with uranium hexafluoride having up to five percent by weight uranium 235 isotope, as little as 15 liters of water could conceivably initiate a critical event. It is therefore vitally important that water be excluded from the cylinder.

There are other risks associated with the shipment of uranium hexafluoride. If this chemical is heated to its triple point of 146° F. in the presence of air, gaseous hydrogen fluoride ($HF_{(g)}$) can be formed. Such an event is conceivable if the valve on an conventional 30B cylinder breaks during a fire event. Hydrogen fluoride gas is extremely harmful, and its release must be guarded against since death follows almost immediately if it is inhaled.

Two openings are formed in the conventional 30B cylinder. The openings are located at approximately diagonally opposite locations on opposite heads. One opening accommodates a valve which is used routinely for filling and emptying the tank of uranium hexafluoride. The other opening is a plug used for periodic inspection, hydrostatic testing, and cleaning of the tank. This valve and this plug form the only barriers to water entry into the conventional 30B cylinder.

During shipment a 30B cylinder is housed in a protective shipping package or "overpack." The overpack protects the cylinder within from accidental impacts and insulates the cylinder to reduce the chance that it will leak if there is a fire or other accidental overheating event. The overpack and 30B cylinder are routinely shipped by ocean-going vessels as well as by rail and road transport. When the cylinder arrives at a processing plant, it is removed from the overpack and standardized piping is connected to the valve. ANSI N14.1 specifies the exact location of the valve as well as its orientation so that the fittings in the processing plant will properly align and connect with the valve. Even a slight change in the valve's position or orientation can make it impossible safely to connect the cylinder to the plant's fittings. Once the 30B is connected to the piping in the processing plant, it is heated in an autoclave to evaporate and so remove the uranium hexafluoride for further processing.

Overpacks are regulated by governmental agencies. The U.S. Department of Transportation (DOT) has issued a standard specification, DOT 21 PF1, which defines an overpack. That regulation is published at 49 CFR 178.358. The Department of Transportation allows certain variations of this design in Certificate USA/4909/AF, Revision 15. Overpacks made to this specification or its permitted variations are termed "specification packages". In addition, the NRC has issued regulations which define so-called "performance packages". These packages are approved by the NRC if they meet the performance standards set forth in the regulations. The performance specifications are published at 49 CFR 173.401–476. One common feature of both the DOT and the NRC regulations is that the overpack must be designed to fit a conventional 30B cylinder as defined by ANSI N14.1

Overpacks and 30B cylinders are tested in combination as required by the NRC prior to approval for use in transporting uranium hexafluoride. One standard test that must be passed is the 30 foot drop test. In this test the 30B cylinder and overpack are dropped from a height of 30 ft. onto an immovable concrete platform. The package is oriented so that the valve on the cylinder points straight down, the worst case scenario. To pass this test, no part of the overpack can touch the valve or any item appurtenant to the valve, and the valve must remain closed tight. If this and the other required tests are passed, the 30B cylinder becomes approved contents for the overpack. Enriched uranium hexafluoride may only be shipped in a 30B cylinder in an overpack for which that cylinder is approved contents.

Regulations require periodic testing of 30B cylinders independent of the overpack. Specifically, the DOT has adopted ANSI N14.1 which in turn requires periodic testing of 30B cylinders. This testing includes a hydrostatic test every five years. Before this test, the cylinder is cleaned. Then it is filled with water and pressurized to inspect for possible leaks. This test checks the integrity of the structure including the various welds. This test is expensive, in part because it creates 26 cubic feet of radioactive waste water which must be disposed as low-level radioactive waste.

Further, the NRC regulates how densely conventional 30B cylinders in overpacks may be packed on cargo ships or other conveyances. It does this by allowing each ship or conveyance a total "transportation index" of 200. Each conventional 30B cylinder has a transportation index of five, so a ship carrying no other nuclear cargo can carry a total of forty (40) conventional 30B cylinders. (200÷5=40.) This safety limit denies shippers of conventional 30B cylinders in standard overpacks the economy that volume shipments could achieve especially in light of the availability of dedicated charter vessels for radioactive materials. However, this regulation is necessary because even though the hydrostatic test assures structural integrity and the overpack provides thermal and impact protection, there is no sure way to guarantee that the valve will remain watertight using the current 30B design. As noted above, even a small amount of water could conceivably initiate a critical event.

It would be a substantial improvement if a cylinder could be devised that did not require periodic hydrostatic testing and which could guarantee the integrity of its valve. Any improvement to the conventional 30B cylinder must recognize the substantial investment in equipment which is used to handle the existing 30B cylinders, including both the piping and the existing overpacks. This requires that the essential dimensions of the cylinder and the location and orientation of the valve not change.

SUMMARY OF THE INVENTION

According to the present invention, a vessel for the shipment of uranium hexafluoride includes a cylindrical wall closed by pair of approximately semi-ellipsoidal heads welded to form a sealed container. A service valve is located in one end. The valve is covered by a removable, watertight valve protection cover assembly. The vessel also includes a test port by means of which the integrity of the valve protection cover assembly may be tested after the cylinder has been filled with uranium hexafluoride and the valve protection assembly has been installed. The valve protection assembly is shaped so that it fits within the envelope of the standard 30B cylinders, and so fits within the overpacks already approved by the NRC and used by shippers of uranium hexafluoride.

The vessel made according to the present invention has a double barrier to prevent ingress of water or egress of uranium hex fluoride. The valve, a first barrier, is enclosed by a cover assembly which forms the second barrier. The double barrier is expected to permit a transportation index of 0. In effect, then, adding the second barrier will allow the improved 30B cylinders to be shipped in bulk in conventional overpacks with safety acceptable to the NRC, resulting in substantial savings to the industry.

DESCRIPTION OF PREFERRED EMBODIMENTS

Figure 1:
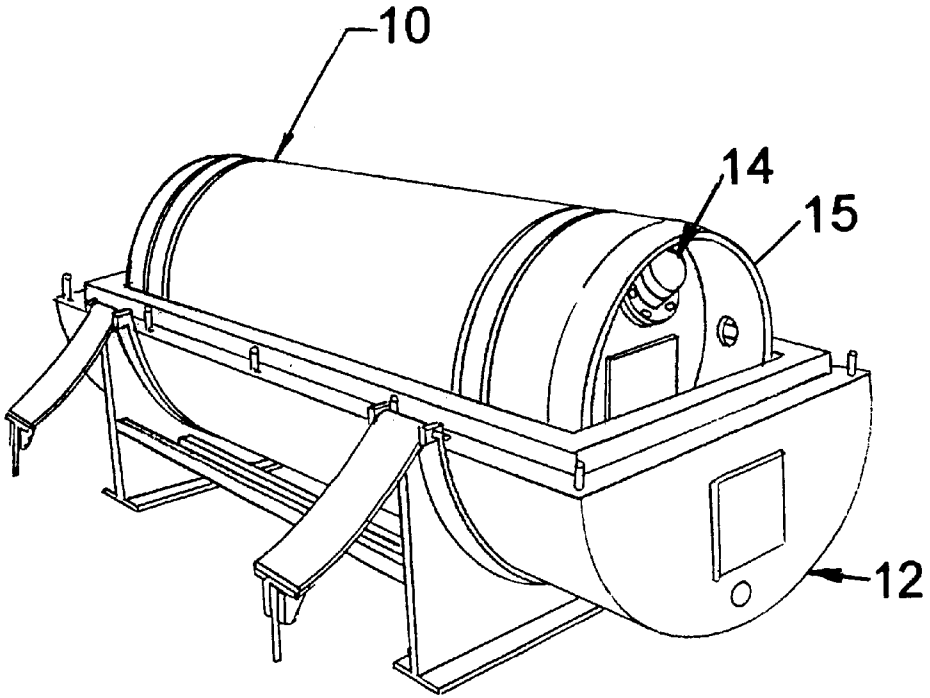
FIG. 1 shows an improved 30B cylinder constructed according to the present invention and held in an open protective shipping package or "overpack" which in turn rests in a cradle.
Figure 1A:
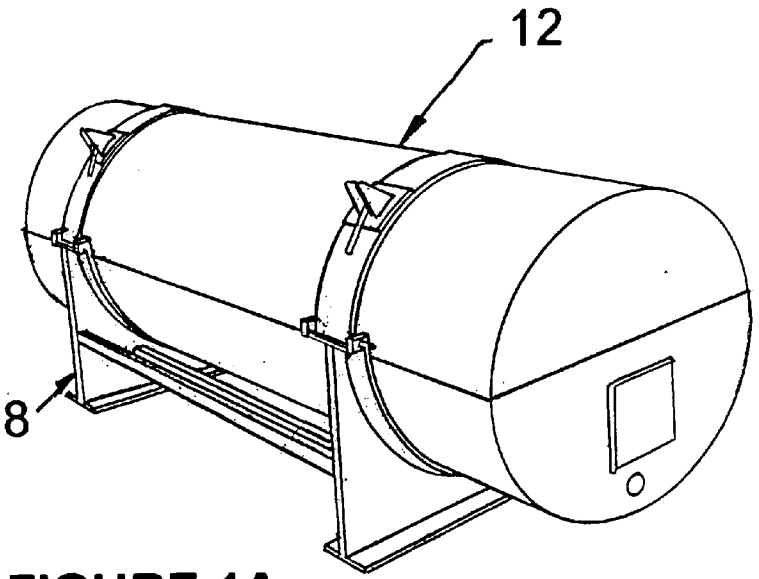
FIG. 1A shows an overpack for a 30B cylinder fully closed and in a cradle.

FIG. 1 shows an improved 30B cylinder 10 constructed in accordance with the present invention. The cylinder 10 is shown inside the bottom half of a protective shipping package or "overpack" 12. The overpack 12 is shown supported in a cradle 8 and with its top half removed and its safety straps open. As is well understood in the art, during shipment to cylinder 10 is filled with up to 5,020 pounds of substantially pure uranium hexafluoride and fully enclosed in the overpack, as shown in FIG. 1A.

For the most part the improved 30B cylinder 10 of the present invention is entirely conventional and will be described in detail only in so far as it differs from the prior art conventional cylinder. The conventional 30B cylinder 10 is manufactured according to ANSI N14.1 and ASME Boiler and Pressure Vessel Code, Section VIII, Division 1. Accordingly the conventional 30B cylinder is 81½ inches plus or minus ½ inch and has a diameter of 30 inches plus or minus ¼ inch. The conventional 30B cylinder has a minimum volume of 26 cubic feet. It is preferred that the cylinder be manufactured according to ANSI N14.1-2000 and therefore include the advantages described in U.S. Pat. No. 5,777,343 which stem from the elimination of a weld backing bar. However, the advantages of the present invention may also be obtained with cylinders manufactured to earlier versions of ANSI N14.1 which required weld backing bars.

Figure 2:
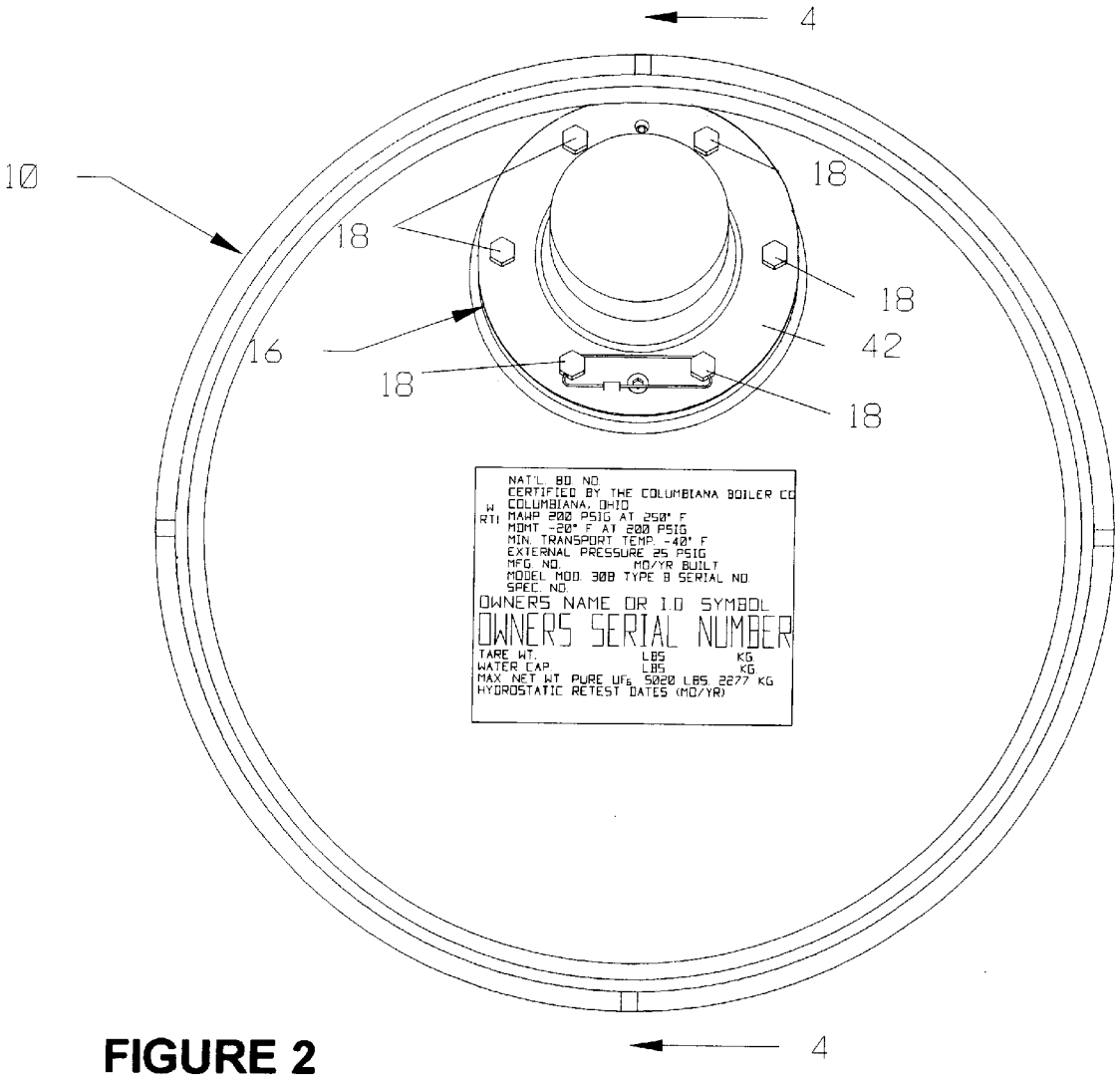
FIG. 2 is an end view of the cylinder of FIG. 1.
Figure 3:
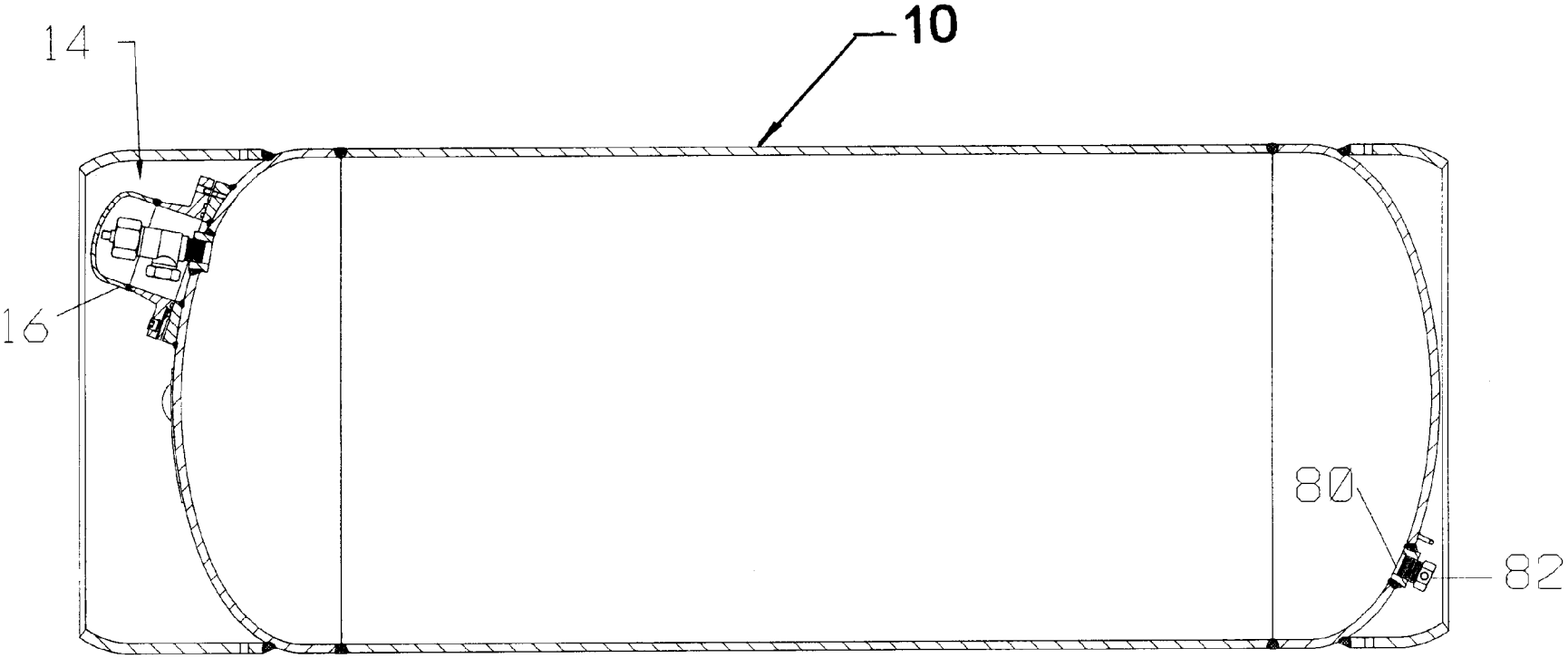
FIG. 3 is a view looking in the direction of arrows 3—3 FIG. 2 and partially in cross section.

The improved 30B cylinder 10 includes a valve which is protected by a valve protection cover assembly 14 (FIGS. 1 and 2). This cover assembly, not found in conventional 30B cylinders, provides a second barrier to the egress of uranium hexafluoride or, more critically, the ingress of water. The valve protection cover assembly 14 fits within the chime 15 which extends from the domed end or head of the cylinder 10. More particularly, the distal end of the valve protection cover assembly 14 is recessed at least ½ inch and preferably 0.75 inches or more from the plane defined by the free edge of the chime. This space allows for deformation of the overpack during the drop test without any contact with the valve protection cover assembly 14. Therefore the cylinder 10 fitted with the cover assembly 14 may be used with standard overpacks such as the overpack 12 shown in FIGS. 1 and 1A.

It should be noted that the axial length of the chime 15 is not fixed by ANSI N14.1, but the overall length, the diameter, and the minimum capacity for the cylinder are fixed. The diameter and length are critical dimensions to ensure that a tank fits in a conventional overpack. Until applicants' invention it had not been recognized that lengthening one chime 15 and shortening the other (unnumbered) to allow a ½ to ¾ or greater inch clearance as discussed above would allow a valve protection cover assembly to survive a 30 foot drop test undamaged, indeed untouched, by the deformation of the overpack, this despite the improved safety and likely resulting reduction in transportation index.

The valve protection cover assembly 14 (FIG. 2) includes a cap 16 that is held in place by six bolts 18. Two of the bolts 18 are safety wired, and the wire is sealed to guarantee that the cap 16 has not been tampered with once it is bolted in place. Additional bolts, up to all six, could be safety wired if desired.

Figure 4:
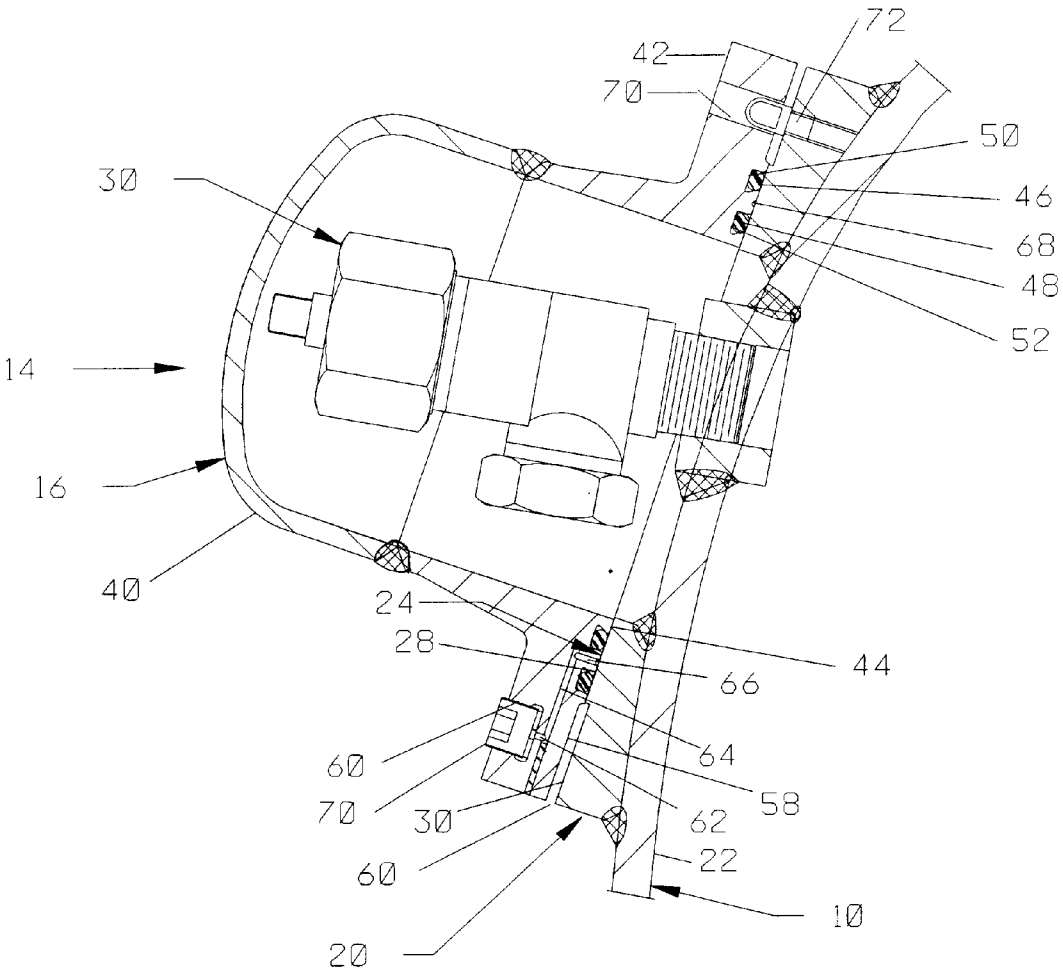
FIG. 4 is an enlarged view of a portion of FIG. 3 showing a valve protection assembly over the valve.

The valve protection cover assembly 14, as shown in greater detail in FIG. 4, includes a cap 16 and a base 20. The base 20 is an annular disk that surrounds the valve 30. The base 20 is a disk that is welded to the wall 22 of the cylinder 10. Its diameter and thickness are selected so as not to interfere with the standard industry plumbing used to connect with the valve 30 to fill or empty the cylinder 10 of uranium hexafluoride.

The base 20 is welded to the wall 22 continuously around its outer and inner-perimeters, and these welds are thoroughly inspected to guarantee their integrity. These welds therefore provide a reliable barrier to prevent any matter from passing under the base 20 and so passing from the outside of the cylinder 10 into the volume where the cap assembly surrounds the valve 30 or vice versa. The base 20 also includes six evenly spaced threaded bores (not shown) with which the bolts 18 cooperate to hold the cap 16 in place.

An upper surface 24 of the base 20 includes two regions, an inner region 28 and an outer region 30. The inner region 28 is annular and stands proud of the outer region by about 1/32 inches. The inner region 28 is machined flat and provides a working surface against which the cap 16 seals. The necessary surface flatness may be achieved by machining the base 20 either before or after welding the base 20 to the wall 22.

The cap 16 is a fabricated steel component which includes a dome 40 and a flange 42. While cap 16 could be machined from a single piece of steel, it is preferred for economy and ease of manufacture to fabricate it from two pieces which are welded together as shown. This weld is thoroughly inspected to guarantee its integrity.

The flange 42 mates with the base 20. To this end the flange 42 includes a machined annular surface 44 which seats against the corresponding flat inner surface 28 of the base 20. A pair of O-rings 46 and 48 fit in recesses 50 and 52, respectively, which are formed in the annular surface 44 of the flange 42. The recesses 50 and 52 are circular in plan view, but any endless shape could be used if desired. The recesses 50 and 52 may be formed with a slight undercut as shown in order to retain the O-rings 46 and 48 in place. When the annular surface 44 and the annular surface 28 are seated against each other, the O-rings 46 and 48 are compressed to form an effective seal. This seal is sufficiently complete to achieve a leak rate of less than $10^{-3}$ ref.-$cm^3$/sec, when tested according, for example, to the soap bubble test described in A.5.7 of ANSI N14.5-1997, Leakage Tests on Packaging for Shipment. Under this test a "reference cubic centimeter cubed per second" is defined as a volume of one cubic centimeter of dry air per second at one atmosphere absolute pressure and 25° C. A seal which has the above leak rate or less is considered essentially impermeable for purposes of this application.

While conventional O-rings 46 and 48 are preferred for ease of manufacture, other resilient sealing elements including cast-in-place rubbers or resilient polymers such as urethane are also possible. Such alternative materials and manufacturing techniques need only provide a sufficiently leak resistant seal to be satisfactory, and they are included within the meaning of the term "resilient seal elements" used in this application.

The flange 42 includes an annular outer region 58, recessed from the plane of annular surface 44. The outer region 58 is aligned with the outer region 30 of the base 20 . The two outer regions 30 and 58 define a gap 60 between them when the cap 16 is in place on the base 20. The flange 42 has six holes (not shown) through the outer region 58 for the bolts 18. These holes aligned with corresponding threaded passages in the base 20. When the cap 16 is put in place and the bolts 18 tightened to a predetermined torque, the outer region 58 of the flange 42 is stressed, assuring a predetermined, constant load on the O-rings 46 and 48 and the mating annular surfaces 24 and 44. While forming the gap 60 is preferred because it allows the flange 42 to flex slightly, any design that allows a sufficiently tight seal between the base 20 and the cap 16 is acceptable.

The valve protection cover assembly 14 includes a means for testing the integrity of the seal between the cap 16 and the base 20. This test facility includes a test port 60, which leads through internal passages 62, 64, and 66 to test channel 68. The test channel 68 is a semicircular recess (in vertical cross-section) in the annular surface 44 of the flange 42. The recess 68 extends in a complete circle spaced between the recesses 50 and 52.

The flange 42 includes a bore 70 (FIGS. 1 and 4) diametrically opposite the test port 60. This bore cooperates with a pin 72 which projects up from the outer region 28 of the base 20. When the cylinder 10 is in its normal, horizontal position, the pin 72 is at the 12 o'clock position and helps the worker accurately position the cap and place the bolts 18 in their holes.

Once the cap 16 is in place and the bolts 18 tightened appropriately, the integrity of the seal around about may be tested. This is done by connecting the test port to a calibrated source of fluid under pressure or vacuum. The fluid reaches the test channel 68, and if the joint is secure, the fluid can go no farther. If a leak occurs, then the test equipment shows a drop in pressure or vacuum, and the O-ring seals can be inspected and replaced or other repairs made as necessary. Once the testing is complete, a plug 70 is used to seal off the test port. There are a variety of test procedures available, and these are set out in ANSI N14.5-1977. These tests assure leakage rate equal to or less than $1\times10^{-3}$ ref-$cm^3$/sec.

Although the testing facility is shown as a port, passages, and channel machined in the flange 42 of the cap 16, it is also possible to machine these elements into the base 20. If this is done, the test channel is formed in the surface 28 of the base 20 so that it is located between the places where the O-rings contact the base 20 and is connected to a test port by suitable passages. Similarly, the O-rings 46 and 48 could be mounted in grooves formed in the base. However, the construction shown in the Figures is preferred because it is easier to maintain and because the O-rings 46 and 48 and the test channel 68 are less likely to be damaged when connecting conduits the valve 30.

While the bolts 18 are used to draw the cap 16 tight against the base 20, other fastenings are possible. For example a threaded connection between the base could be used with the necessary O-ring seals and test port channel formed in a screw-on cap. Alternatively, the base 20 could have external threats on its outer peripheral surface and a nut like that used in a plumber's union could be used to pull the cap down against the base.

Thus it is clear that the present invention provides a vessel 10 for the shipment of uranium hexafluoride includes a cylindrical wall closed by pair of approximately semi-ellipsoidal heads 22 welded to form a sealed container. A service valve 30 is located in one end. The valve 30 is covered by a removable, watertight valve protection cover assembly 14. The vessel also includes a test port 60 by means of which the integrity of the valve protection cover assembly may be tested after the cylinder 10 has been filled with uranium hexafluoride and the valve protection assembly 14 has been installed. The valve protection assembly 14 is shaped so that it fits within the envelope of the standard 30B cylinders, and so fits within the overpacks already approved by the NRC and owned by shippers of uranium hexafluoride.

The vessel 10 made according to the present invention has a double barrier to prevent ingress of water or egress of uranium hexafluoride. The valve 30, a first barrier, is enclosed by a cover assembly 14 which forms the second barrier. The double barrier is expected to permit the transportation index of 0. In effect, then, adding the second barrier will allow the improved 30B cylinders to be shipped in bulk with safety acceptable to the NRC, resulting in substantial savings to the industry.

What is claimed is:

1. A cylinder for the transport of substantially pure uranium hexafluoride in a conventional overpack, the cylinder comprising a closed steel vessel, the vessel having a cylindrical sidewall and a head closing one end of the vessel, the head being permanently affixed to the sidewall, the head having a valve controlling the flow of matter into and out of the vessel, a sealing surface connected to the vessel and surrounding the valve, a cap over the valve, and fastening means for pressing the cap against the sealing surface to seal a joint between them against the flow of matter from outside the cap to the valve and from the valve to outside the cap.

2. The cylinder of claim 1 including a disk surrounding the valve and the sealing surface is a surface of the disk.

3. The cylinder of claim 1 wherein the fastening means includes a threaded fastener.

4. The cylinder of claim 1 wherein the fastening means includes a plurality of threaded fasteners.

5. The cylinder of claim 1 wherein the sealing surface is an annular surface and the cap includes an opposed surface proportioned to abut the sealing surface, and further including a resilient seal element disposed between the opposed surface and the sealing surface.

6. The cylinder of claim 5 including an endless recess formed in the opposed surface of the cap and surrounding the valve when the opposed surface abuts the sealing surface.

7. The cylinder of claim 6 wherein the resilient seal is disposed at least partially within the recess formed in the opposed surface.

8. The cylinder of claim 1 including means for testing the integrity of the seal between the cap and the sealing surface when the fastening means presses the cap against the sealing surface.

9. The cylinder of claim 8 including a pair of resilient seal elements, one surrounding the other, the resilient seal elements being positioned between the cap and the sealing surface.

10. The cylinder of claim 9 wherein the means for testing the integrity of a seal includes a passage connecting an outside surface of the cap with a space between the two resilient seal elements.

11. The cylinder of claim 10 wherein the cap includes a working surface proportioned to abut the sealing surface, the working surface having a first endless recess surrounding the valve when the cap is over the valve, a second endless recess surrounding the first endless recess, and resilient seal elements disposed in the recesses.

12. The cylinder of claim 11 wherein the resilient seal elements are O-rings.

13. The cylinder of claim 1 wherein the vessel includes a chime connected to the head and extending axially away from the head, the chime having a free end defining a plane, the valve sealing surface and cap being surrounded by the chime, and being spaced inward toward the head from the plane.

14. The cylinder of claim 13 wherein the cap is spaced inward from the plane toward the head by at least ½ in.

15. The cylinder of claim 14 including means for testing the integrity of the seal between the cap and the sealing surface when the fastening means presses the cap against the sealing surface.

16. The cylinder of claim 15 including a pair of resilient seal elements, one surrounding the other, the resilient seal elements being positioned between the cap and the sealing surface.

17. The cylinder of claim 16 wherein the means for testing the integrity of a seal includes a passage connecting an outside surface of the cap with a space between the two resilient seal elements.

18. The cylinder of claim 17 wherein the cap includes a working surface proportioned to abut the sealing surface, the working surface having a first endless recess surrounding the valve when the cap is over the valve, a second endless recess surrounding the first endless recess, and resilient seal elements disposed in the recesses.

19. The cylinder of claim 18 wherein the resilient seal elements are O-rings.

20. The cylinder of claim 13 wherein the cap is spaced inward from the plane toward the head by at least ¾ in.

21. The cylinder of claim 20 including means for testing the integrity of the seal between the cap and the sealing surface when the fastening means presses the cap against the sealing surface.

22. The cylinder of claim 21 including a pair of resilient seal elements, one surrounding the other, the resilient seal elements being positioned between the cap and the sealing surface.

23. The cylinder of claim 22 wherein the means for testing the integrity of a seal includes a passage connecting an outside surface of the cap with a space between the two resilient seal elements.

24. The cylinder of claim 23 wherein the cap includes a working surface proportioned to abut the sealing surface, the working surface having a first endless recess surrounding the valve when the cap is over the valve, a second endless recess surrounding the first endless recess, and resilient seal elements disposed in the recesses.

25. The cylinder of claim 24 wherein the resilient seal elements are O-rings.

26. In a conventional 30B cylinder for the transport of substantially pure uranium hexafluoride which has a cylindrical sidewall, a head closing one end of the cylinder and permanently affixed to the sidewall, and a valve connected to the head for controlling the flow of material into and out of the cylinder, the improvement comprising a removable protective valve cover assembly means for providing an essentially impermeable cover over the valve, and means for testing a seal between the valve cover assembly means and the cylinder.

27. The improvement of claim 26 wherein the protective valve cover assembly means includes a cap having a flange and a sealing surface connected to the cylinder and surrounding the valve.

28. The improvement of claim of 27 including a pair of resilient seal elements, one within the other, positioned between the flange and the sealing surface, and the means for testing includes a passage from outside the protective valve cover assembly to a space between the resilient seal elements.

29. A method of shipping substantially pure uranium hexafluoride comprising providing a cylinder having a cylindrical sidewall, a head closing one end of the cylinder and permanently affixed to the sidewall, and a valve connected to the head for controlling the flow of matter into and out of the cylinder and a removable cap over the valve, removing the cap, filling the cylinder with uranium hexafluoride through the valve, closing the valve, placing the cap over the valve to seal the space between the inside of the cap and the valve, and thereafter testing the integrity of the seal.

30. The method of claim 29 further including the step of placing the cylinder inside a conventional overpack.

31. In the combination of an overpack for a conventional 30B cylinder and a conventional 30B cylinder containing substantially pure uranium hexafluoride in the overpack, the cylinder having a cylindrical sidewall, a head closing one end of the cylinder and permanently affixed to the sidewall, and a valve connected to the head, the improvement comprising a removable protective valve cover assembly, means for providing an essentially impermeable cover over the valve, and means for testing a seal between the valve cover assembly means and the cylinder.

32. The improvement of claim 31 wherein the protective valve cover assembly means includes a cap having a flange and a sealing surface connected to the cylinder and surrounding the valve.

33. The improvement of claim of 32 including a pair of resilient seal elements, one within the other, positioned between the flange and the sealing surface, and the means for testing includes a passage from outside the protective valve cover assembly to a space between the resilient seal elements.

34. A cylinder for the transport of substantially pure uranium hexafluoride fitting within an envelope having an overall length of 81½ inches plus or minus ½ inch and a diameter of 30 inches plus or minus ¼ inch, the cylinder enclosing a volume of at least 26 cubic feet, the cylinder comprising a closed steel vessel having a cylindrical sidewall, a head closing one end of the cylinder and permanently affixed to the sidewall, and a valve connected to the head for controlling the flow of matter into and out of the vessel, a sealing surface connected to the vessel surrounding the valve, a removable cap over the valve, and fastening means for sealingly mounting the cap to the sealing surface.

35. The cylinder of claim 34 including chimes within the envelope of the cylinder.

36. The cylinder of claim 35 where in the removable cap is completely within the envelope of the cylinder when the cap is mounted to the sealing surface.

37. The cylinder of claim 36 including means for testing the rate at which matter can flow between the sealing surface and the cap when the cap is mounted to the sealing surface.

38. The cylinder of claim 37 including a pair of resilient sealing elements between the cap and the sealing surface and the means for testing includes a passage having one end between the two resilient sealing elements and another end adapted to be connected to a source of fluid under pressure or vacuum.

39. The cylinder of claim 38 disposed within a conventional overpack.

* * * * *